US006675542B1

(12) United States Patent
Norton et al.

(10) Patent No.: US 6,675,542 B1
(45) Date of Patent: Jan. 13, 2004

(54) HOUSING FOR AN INTERNAL COMBUSTION ENGINE

(76) Inventors: Aaron I. Norton, 16868 County Road 31, Pt. A, Weston, CO (US) 81091; Clinton D. Hargis, 34363 Hwy. 12, Trinidad, CO (US) 81082; Gourdin S. Fatur, 34363 Hwy. 12, Trinidad, CO (US) 81082

( * ) Notice: Subject to any disclaimer, the term of this patent is extended or adjusted under 35 U.S.C. 154(b) by 69 days.

(21) Appl. No.: 10/170,660

(22) Filed: Jun. 14, 2002

(51) Int. Cl.[7] ..... E04F 17/04

(52) U.S. Cl. ..... 52/302.1; 52/79.1; 52/144; 52/145; 454/228; 454/237

(58) Field of Search ..... 52/79.1, 302.1, 52/144, 145; 454/168–172, 173–183, 188, 228–237, 241–244, 254, 339, 370, 269, 270, 271, 272

(56) References Cited

U.S. PATENT DOCUMENTS

| | | | | | |
|---|---|---|---|---|---|
| 1,495,406 | A | * | 5/1924 | Deyo | 52/302.1 |
| 1,798,791 | A | * | 3/1931 | Grothaus | 454/241 |
| 1,995,213 | A | * | 3/1935 | Martin | 119/302 |
| 2,061,712 | A | * | 11/1936 | Martin | 119/306 |
| 2,922,299 | A | | 1/1960 | Deam | |
| 3,570,385 | A | * | 3/1971 | Heisterkamp et al. | 454/187 |
| 3,714,746 | A | | 2/1973 | Barlow | |
| 4,015,381 | A | | 4/1977 | Schmidt | |
| 4,103,825 | A | * | 8/1978 | Zornig | 126/632 |
| 4,399,738 | A | * | 8/1983 | Sharkey | 454/237 |
| 4,555,877 | A | | 12/1985 | Libra | |
| 4,649,676 | A | | 3/1987 | Davey | |
| 4,715,268 | A | * | 12/1987 | Tanner | 454/256 |
| 4,757,641 | A | | 7/1988 | Penrod | |
| 4,846,261 | A | * | 7/1989 | Kittila | 165/54 |
| 4,973,191 | A | | 11/1990 | Dannhäuser | |
| 5,097,548 | A | | 3/1992 | Heck et al. | |
| 5,123,874 | A | * | 6/1992 | White, III | 454/251 |
| 5,473,844 | A | * | 12/1995 | Martin | 52/79.1 |
| 5,501,046 | A | * | 3/1996 | Hattingh et al. | 52/266 |
| 5,934,993 | A | * | 8/1999 | Maruyama | 454/250 |
| 5,989,417 | A | | 11/1999 | Fleischhacker | |
| 6,023,890 | A | * | 2/2000 | Zenobi | 52/64 |
| 6,240,690 | B1 | * | 6/2001 | James et al. | 52/302.3 |
| 6,260,319 | B1 | * | 7/2001 | Colomban | 52/404.1 |

* cited by examiner

*Primary Examiner*—Jeanette Chapman
(74) *Attorney, Agent, or Firm*—Donald R. Schoonover

(57) ABSTRACT

A housing includes side walls having a plurality of offset sections with air exit gaps defined between adjacent sections and a roof with an air exit gap defined therein. The housing also includes an air intake section and a door section. The air flow is balanced so sufficient air flows through the structure to maintain proper environmental conditions inside the structure while noise is contained within the structure. Acoustic panels are mounted on the structure to further absorb noise. The structure can be designed to be aesthetically pleasing as well. Lifting eyes as well as anchors can also be included and the structure can be either fabricated on site or elsewhere and shipped as needed.

3 Claims, 8 Drawing Sheets

HOUSING FOR AN INTERNAL COMBUSTION ENGINE

BACKGROUND OF THE INVENTION

1. Field of the Invention

The present invention relates to the general art of static structures, and to the particular field of gasoline engine housing structures.

2. Discussion of the Related Art

Many industrial operations require the use of gasoline engines. Drilling operations and the like are examples of such industrial operations. However, those skilled in the art will be able to envision many other such operations.

The engines used in such operations are often located outdoors. This presents several problems. Included among the problems is the exposure of the engine to the environment, which is especially difficult if the environment is harsh. Still other problems include the noise generated by the engine when it is in operation, which can create environmental issues with neighbors, especially in or near residential areas. Since an engine of this sort is not visually appealing, such engines may create problems associated with the aesthetics of such an engine. It is also noted that an exposed engine may be subject to vandalism.

Buildings presently used in industries, such as the gas exploration industry, are generally one-piece units with a screen wire opening on one end and openable doors on the other end. Such buildings cannot be totally closed during engine operation because such total closure may prevent air from flowing to the engine during engine operation thereby endangering the engine from overheating or even creating a danger of accumulated exhaust gases near the engine. Access to an engine in such buildings may be difficult and the building may not be amenable to accommodating various sizes of engines.

Still further, some presently available buildings are fabricated from metal which generally cannot be made aesthetically pleasing and may amplify noise associated with engine operation.

Still further, many presently available buildings are not easily moved from one site to another and may have to be transported from an assembly area to the site. This may create transportation issues.

PRINCIPAL OBJECTS OF THE INVENTION

It is a main object of the present invention to provide a housing for an engine, such as a gasoline engine.

It is another object of the present invention to provide a housing for an engine, such as a gasoline engine, that is easily constructed.

It is another object of the present invention to provide a housing for an engine, such as a gasoline engine, that will substantially reduce engine noise at neighboring locations while still permitting proper air flow to the engine.

It is another object of the present invention to provide a housing for an engine, such as a gasoline engine, that can be constructed at one location and easily transported to another location.

It is another object of the present invention to provide a housing for an engine, such as a gasoline engine, that can be constructed on site.

It is another object of the present invention to provide a housing for an engine, such as a gasoline engine, that can be made aesthetically pleasing.

It is another object of the present invention to provide a housing for an engine, such as a gasoline engine, that can protect the engine from environmental conditions.

It is another object of the present invention to provide a housing for an engine, such as a gasoline engine, that can protect the engine from vandalism.

It is another object of the present invention to provide a housing for an engine, such as a gasoline engine, that can protect the engine from unforseen problems associated with open air operation and exposure of the engine.

It is another object of the present invention to provide a housing for an engine, such as a gasoline engine, that can protect the engine while controlling emissions associated with the engine.

It is another object of the present invention to provide a housing for an engine, such as a gasoline engine, that can protect the engine while also controlling heat associated with engine operation.

It is another object of the present invention to provide a housing for an engine, such as a gasoline engine, that is amenable to a wide variety of engine sizes.

It is another object of the present invention to provide a housing for an engine, such as a gasoline engine, that will protect the engine while also permitting easy access to the engine.

SUMMARY OF THE INVENTION

These, and other, objects are achieved by a static structure for housing a gasoline engine which comprises a front end wall, a rear end wall, a loadable door in the front end wall, a shroud unit on the rear end wall, a roof, a first side wall, a second side wall, and a plurality of offset sections in both the first side wall and the second side wall. Each offset section of the plurality of offset sections is spaced apart from offset sections immediately adjacent thereto, and an air exit gap is defined between each offset section and the offset sections adjacent thereto. The air gaps are sized to permit air to flow out of the interior of the static structure but will keep most, if not all, of the noise associated with engine operation within the structure. The walls and roof of the structure can be painted and shaped to present a pleasing aesthetic appearance that blends with the area in which the structure is located. Siding and shingles can also be added if desired.

The structure further includes an air exit gap defined through the roof with the roof air gap being sized to cooperate with the exit air gaps in the walls to permit air flow and heat flow out of the structure while containing noise within the structure. Air flows into the structure via an air intake duct connected to the shroud unit. An acoustic panel is mounted on each offset section and a plurality of acoustic panels are mounted on the roof. The acoustic panels absorb noise and contain such noise in the structure. An inlet air gap is defined between the shroud unit and the rear wall, with the inlet air gap being fluidically connected to said air intake duct.

BRIEF DESCRIPTION OF THE DRAWING FIGURES

FIG. 7 is a top plan view of the static structure of the present invention.

DETAILED DESCRIPTION OF THE INVENTION

Other objects, features and advantages of the invention will become apparent from a consideration of the following detailed description and the accompanying drawings.

Figure 11:
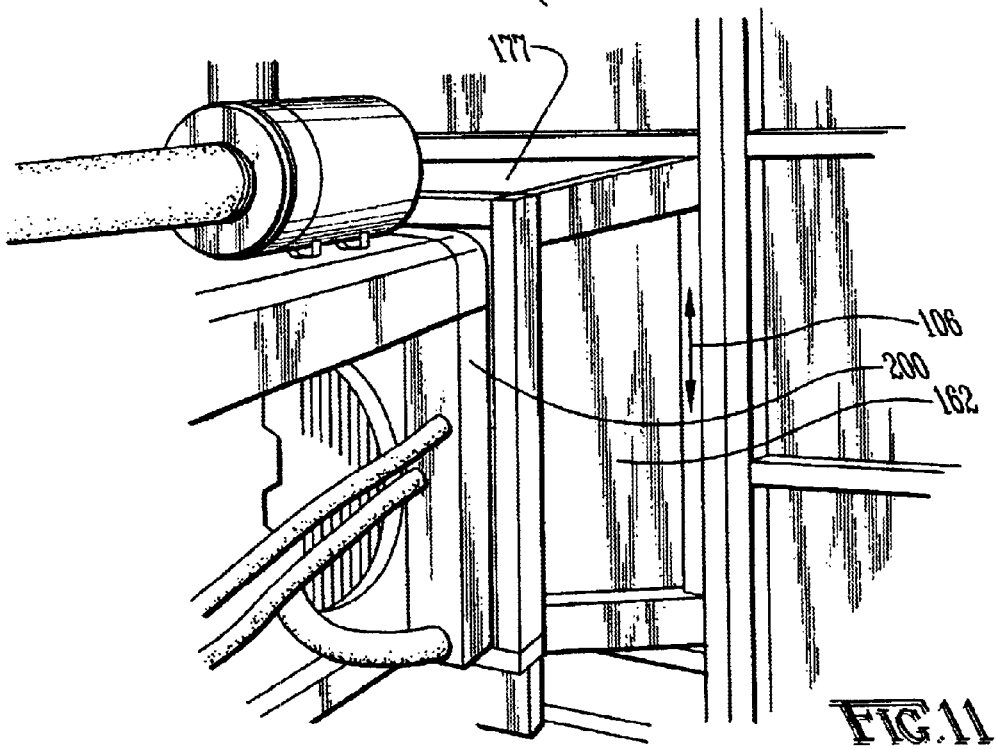
FIG. 11 is a side perspective view of the air intake duct of the structure of the present invention.

The present invention is embodied in a static structure 10 for housing a gasoline engine broadly comprising a front end wall 12, a rear end wall 14, a first side wall 16, a second side wall 18 and a roof 20. In general, the structure is placed on ground G around a gasoline engine 22 (see FIG. 11) to cool that engine and the elements associated therewith while simultaneously abating the noise associated with operation of that engine. Structure 10 includes an air flow/noise abatement control system that permits just enough air to flow past the gasoline engine to keep it cool, but not so much air as to permit an undue amount of noise to escape from the structure. Structure 10 also protects the gasoline engine from the elements, especially if the engine is operating in very harsh environments.

Figure 1:
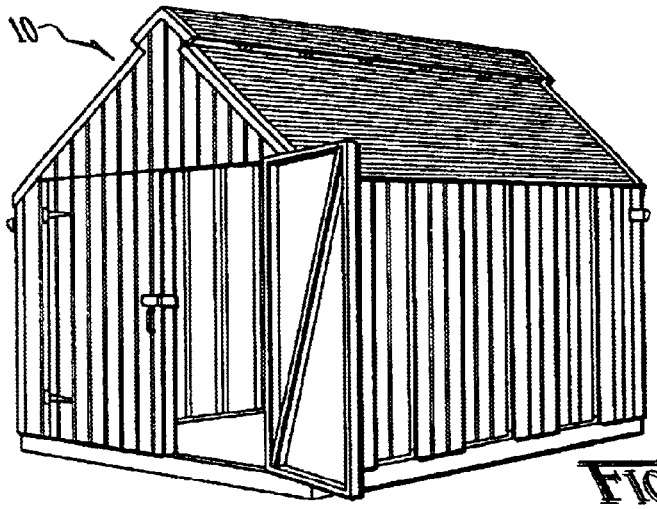
FIG. 1 is a perspective view of the static structure embodying the present invention in a set up configuration.
Figure 2:
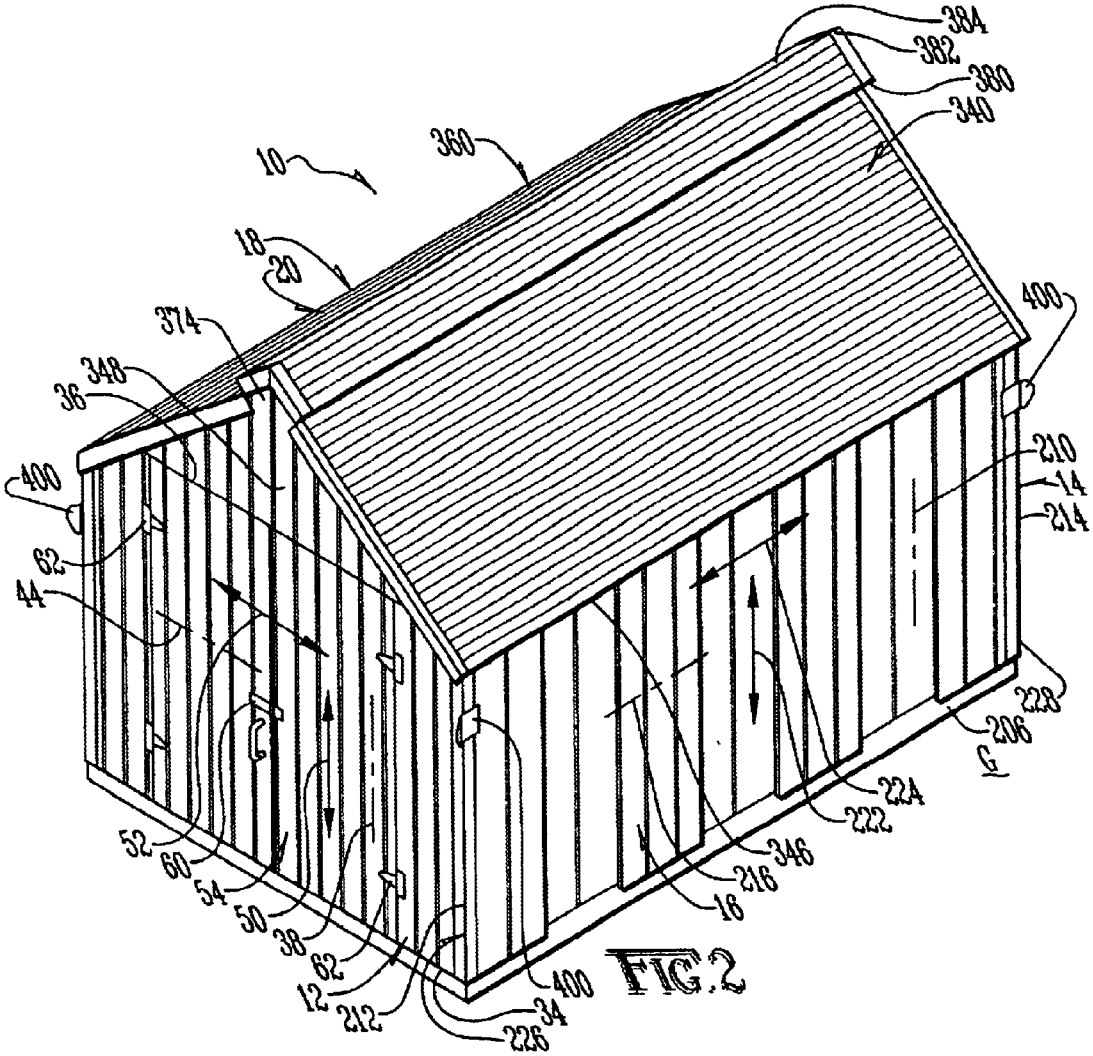
FIG. 2 is a perspective view of the static structure embodying the present invention.

More specifically, referring to FIGS. 2 and 7, it can be seen that front end wall 12 has an inside surface 30, an outside surface 32, a bottom edge 34 that is located on the ground when the front end wall is in a set-up configuration such as shown in FIGS. 1 and 2, and a top edge 36 spaced apart from the bottom edge. A longitudinal axis 38 extends between top edge 36 and bottom edge 34. The front end wall further includes a first side edge 40, a second side edge 42 and a transverse axis 44 which extends between first side edge 40 and second side edge 42. A plurality of studs, such as stud 46, are located on the inside surface 30 of the front end wall 12 and extend from the top edge 36 of the front end wall 12 to the bottom edge 34 of the front end wall 12. The studs 46 are spaced apart from each other in the direction of the transverse axis 44 of the front end wall 12.

A plurality of acoustic panels, such as acoustic panel 48, are mounted on the inside surface 30 of the front end wall 12 between the studs 46 with each acoustic panel 48 being located between adjacent studs 46. The front end wall 12 has a length dimension 50 extending in the direction of the longitudinal axis 38 from the top edge 36 to the bottom edge 34 of the front end wall 12 and a width dimension 52 extending in the direction of the transverse axis 44 from the first side edge 40 to the second side edge 42 of the front end wall 12.

Double doors 54 are located on the front end wall 12 and include an inside surface 56 on each door of the double doors 54, an outside surface 58 on each door of the double doors 54, a lock 60 on the double doors 54, and hinges, such as hinge 62, connect each of the doors of the double doors 54 to the front end wall 12. Acoustic panels, such as acoustic panel 64, are located on each door of the double doors 54. The doors swing out as indicated in FIG. 7 to permit a gasoline engine 22 to be moved into and out of the structure 10. The double doors 54 provide sufficient space for most engines to move therethrough; however, if a very large engine is encountered, the entire structure 10 can be erected around the engine and then dismantled as necessary. One form of the doors includes double doors, each of which is six to seven feet in height, with an overall door opening being as much as seven feet wide to allow easy machinery access. The overall structure is, in one form of the invention, ten feet wide and twelve feet long.

Figure 3:
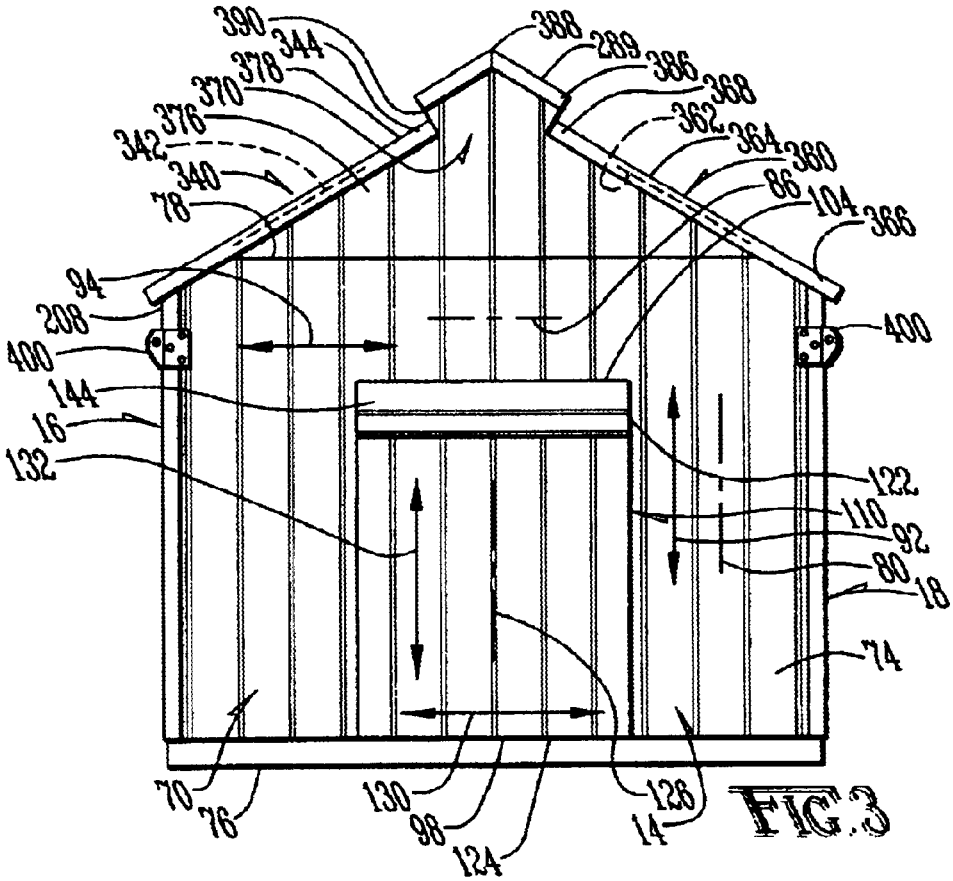
FIG. 3 is rear end elevational view of the static structure.

As shown in FIGS. 3 and 7, structure 10 further includes the rear end wall 14. Rear end wall 14 includes an inside surface 72, an outside surface 74, a bottom edge 76 that is located on the ground when the rear end wall 14 is in a set-up configuration, and a top edge 78 spaced apart from the bottom edge 76 of the rear end wall 14. A longitudinal axis 80 extends between the top edge 78 of the rear end wall 14 and the bottom edge 76 of the rear end wall 14. Rear end wall 14 further includes a first side edge 82 and a second side edge 84. A transverse axis 86 extends between the first side edge 82 of the rear end wall 14 and the second side edge 84 of the rear end wall 14.

A plurality of studs, such as stud 88, are mounted on the inside surface 72 of the rear end wall 14 and extend from the top edge 78 of the rear end wall 14 to the bottom edge 76 of the rear end wall 14. The studs 88 are spaced apart from each other in the direction of the transverse axis 86 of the rear end wall 14. A plurality of acoustic panels, such as acoustic panel 90, are mounted on the inside surface 72 of the rear end wall 14 between the studs 88 with each acoustic panel 90 being located between adjacent studs 88 on the rear end wall 14. Rear end wall 14 further includes a length dimension 92 extending in the direction of the longitudinal axis 80 from the top edge 78 to the bottom edge 76 of the rear end wall 14, and a width dimension 94 extends in the direction of the transverse axis 86 from the first side edge 82 of the rear end wall 14 to the second side edge 84 of the rear end wall 14.

An opening 96 is defined through the rear end wall 14 and being defined by a bottom edge 98, a first side 100 spaced from the first side edge 82 of the rear end wall 14 in the direction of the transverse axis 86 of the rear end wall 14, a second side 102 spaced from the second side edge 84 of the rear end wall 14 in the direction of the transverse axis 86 of the rear end wall 14, a top edge 104 which extends in the direction of the transverse axis 86 of the rear end wall 14 between the first side 100 of the opening 96 and the second side 102 of the opening 96 and is spaced apart from the top edge 78 of the rear end wall 14 in the direction of the longitudinal axis 80 of the rear end wall 14. The opening 96 further includes a width dimension 105 which extends between the first side 100 of the opening 96 and the second side 102 of the opening 96 in the. direction of the transverse axis 86 of the rear end wall 14, and a length dimension 106 (see FIG. 11) which extends between the top edge 104 of the opening 96 and the bottom edge 98 of the opening 96,in the direction of the longitudinal axis 80 of the rear end wall 14.

Structure 10 further includes a shroud unit 110 on the rear end wall 14 which includes a front wall 112 spaced apart from the outside surface 74 of the rear end wall 14. The front wall 112 includes an inside surface 114 which is spaced apart from the outside surface 74 of the rear end wall 14, a first side edge 116 which is spaced apart from the first side 100 of the opening 96 in the rear end wall 14, a second side edge 118 which is spaced apart from the second side 102 of the opening 96 in the rear end wall 14. A transverse axis 120 extends between the first side edge 116 of the front wall 112 of the shroud unit 110 and the second side edge 118 of the shroud unit 110. The front wall 112 of the shroud unit 110 further includes a top edge 122 which is spaced apart from the top edge 104 of the opening 96 of the rear end wall 14 and spaced apart from the outside surface 74 of the rear end wall 14, and a bottom edge 124 that is spaced apart from the ground when the shroud unit 110 is in the set-up configuration and is spaced apart from the bottom edge 76 of the rear end wall 14. The front wall 112 further includes a longitudinal axis 126 extending between the top edge 122 of the front wall 112 of the shroud unit 110 and the bottom edge 124 of the front wall 112 of the shroud unit 110 and a width dimension 130 measured in the direction of the transverse axis 120 of the front wall 112 of the shroud unit 110. The width dimension of the front wall 112 of the shroud unit 110 is greater than the width dimension of the opening 96 in the rear end wall 14. The front wall 112 of the shroud unit 110 further includes a length dimension 132 measured in the direction of the longitudinal axis 126 of the front wall 112 of the shroud unit 110, and the length dimension of the front wall 112 of the shroud unit 110 is less than the length dimension of the opening 96 in the rear end wall 14.

The relative dimensions of the front wall 112 of the shroud unit 110 and the opening 96 in the rear wall of the structure 10 creates a first air intake gap 140 between the first side edge 116 of the front wall 112 of the shroud unit 110 and the first side 100 of the opening 96 in the rear end wall 14 and a second air intake gap 142 defined between the second side edge 118 of the front wall 112 of the shroud unit 110 and the second side 102 of the opening 96 in the rear end wall 14.

The shroud unit 110 further includes a top wall 144 connecting the top edge 122 of the front wall 112 of the shroud unit 110 to the outside surface 74 of the rear end wall 14 adjacent to the top edge 104 of the opening 96 in the rear end wall 14. Due to the relative dimensions of the opening 96 in the rear wall and the front wall 112 of the shroud unit 110, the top wall 144 of the shroud unit 110 slopes toward the bottom edge 124 of the front wall 112 of the shroud unit 110.

The shroud unit 110 further includes support struts, such as support strut 150, on the front wall 112 of the shroud unit 110. The preferred form of the structure 10 includes four support struts, one on each corner of the front wall 112. Each support strut 150 includes a proximal end 152 fixed to the inside surface 114 of the front wall 112 of the shroud unit 110 and extends toward the rear end wall 14. The support struts 150 converge toward each other from the proximal ends 152 and have distal ends, such as distal end 156 of strut 150, which are spaced apart from the proximal ends 152 of the struts 150. The support struts 150 are spaced apart from each other. The shroud unit 110 can be removed in some forms of the structure 10.

Figure 10:
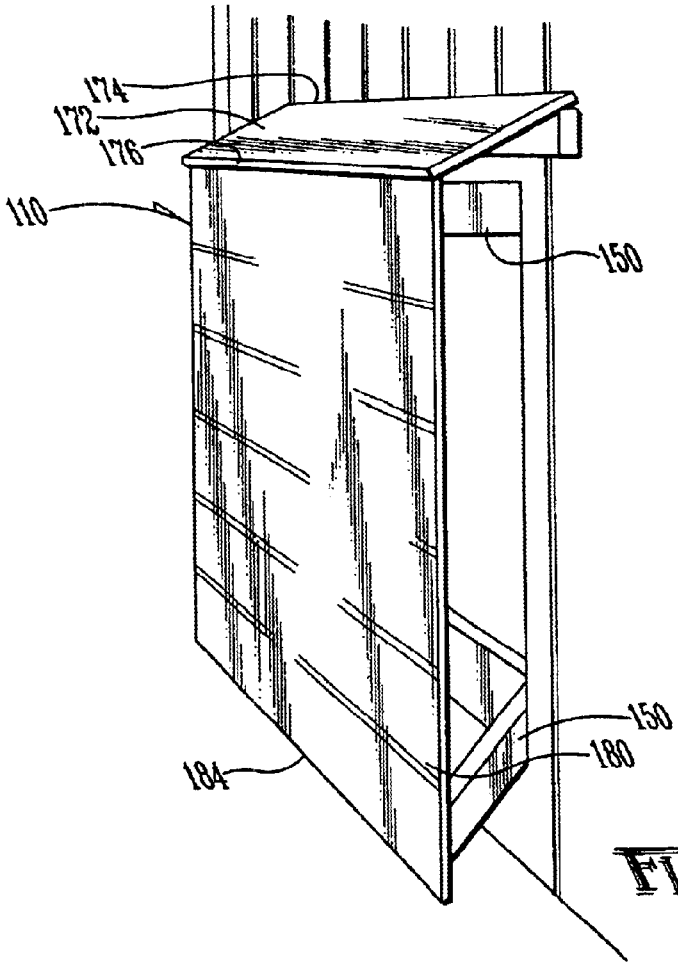
FIG. 10 is a perspective view of a shroud unit.

An intake air duct unit 160 is located on the rear wall and includes a first duct unit side wall 162 having a proximal end 164 located adjacent to the rear end wall 14 and a distal end 166 spaced apart from the inside surface 72 of the rear end wall 14. Duct unit 160 further includes a second duct unit side wall 168 having a proximal end 170 located adjacent to the rear end wall 14 and a distal end 171 spaced apart from the inside surface 72 of the rear end wall 14. The shroud unit 110 further includes a shroud unit top wall 172 (FIG. 10) having a proximal end 174 located adjacent to the rear end wall 14 and a distal end 176 spaced apart from the rear end wall 14. Duct unit 160 further includes a duct unit top wall 177 and a duct unit bottom wall 178. Shroud unit 110 further includes a shroud unit bottom wall 180 having a proximal end 182 located adjacent to the rear end wall 14 and a distal end 184 spaced apart from the inside surface 72 of the rear end wall 14.

Figure 12:
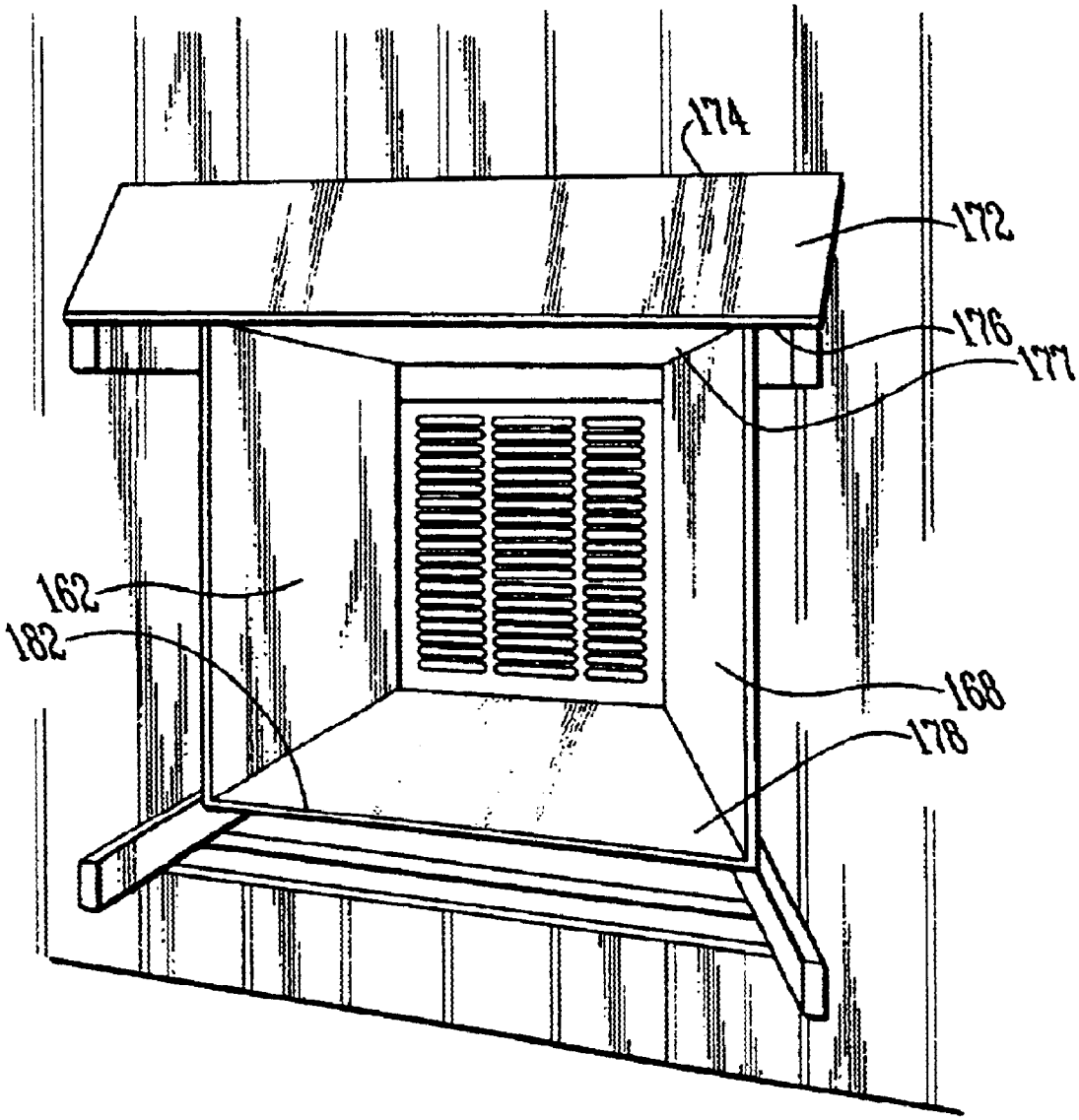
FIG. 12 is a front perspective view of the air intake duct.

As can be seen in FIGS. 7 and 12, first duct unit side wall 162, second duct unit side wall 168, duct unit top wall 177 and duct unit bottom wall 178 define an air intake duct opening 188 that is spaced apart from the inner surface 72 of the rear end wall 14. An intake air path shown in FIG. 7 by dotted lines 190, is defined between the first air intake gap 140 and the second air intake gap 142 of the shroud unit 110 and the air intake duct opening 188.

An intake air fan 200 is shown in FIG. 7 and is located near the air intake duct opening 188 to be in fluid communication with the intake air path 190 of the shroud unit 110 to draw outside air through the air intake path 190 and onto a gasoline engine 22 or other such device that is housed in structure 10. The fan 200 can be removably positioned within the structure 10 if desired. The structure 10 can also be formed of any suitable materials.

Figure 4:
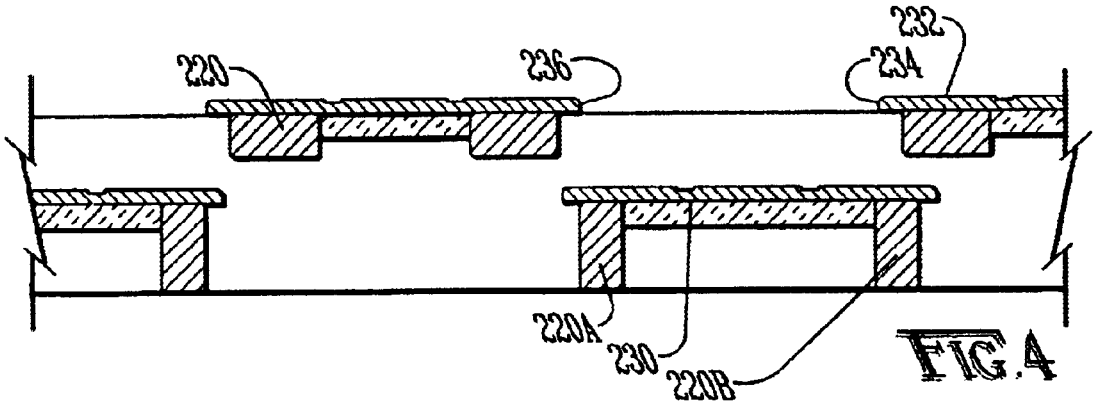
FIG. 4 is a top plan view of a portion of a side wall of the static structure embodying the present invention showing the offset portions thereof.

Referring to FIGS. 2, 4 and 7, it can be seen that first side wall 16 of structure 10 extends between the front end wall 12 and the rear end wall 14. First side wall 16 includes an inside surface 202, an outside surface 204, a bottom edge 206 that is located on the ground when the first side wall 16 is in a set-up configuration and a top edge 208 spaced apart from the bottom edge 206 of the first side wall 16. A longitudinal axis 210 extends between the top edge 208 of the first side wall 16 and the bottom edge 206 of the first side wall 16. Side wall 16 further includes a first side edge 212 and a second side edge 214. A transverse axis 216 extends between the first side edge 212 of the first side wall 16 and the second side edge 214 of the first side wall 16.

A plurality of studs, such as stud 220, are located on the inside surface 202 of the first side wall 16 and extend from the top edge 208 of the first side wall 16 to the bottom edge 206 of the first side wall 16. The studs 220 are spaced apart from each other along the transverse axis 216 of the first side wall 16. First side wall 16 has a length dimension 222 extending in the direction of the longitudinal axis 210 of the first side wall 16 from the top edge 208 of the first side wall 16 to the bottom edge 206 of the first side wall 16 and a width dimension 224 extending in the direction of the transverse axis 216 of the first side wall 16 from the first side edge 212 of the first side wall 16 to the second side edge 214 of the first side wall 16. The structure 10 further includes a first front corner 226 located between the first side edge 212 of the first side wall 16 and the first side edge 40 of the front end wall 12 and a first rear corner 228 located between the second side edge 214 of the first side wall 16 and the first side edge 82 of the rear end wall 14.

As can be seen in FIGS. 4 and 7, structure 10 includes a plurality of offset sections in the first side wall 16. Each offset section includes an inside surface 230, outside surface 232 and two studs, such as studs 220A and 220B, on the inside surface 230 of each offset section. Each offset section further includes a first side edge 234 extending between the top edge 208 of the first side wall 16 and the bottom edge 206 of the first side wall 16 and a second side edge 236 extending between the top edge 208 of the first side wall 16 and the bottom edge 206 of the first side wall 16, with the second side edge 236 of each offset section being spaced apart from the first side edge 234 of the offset section in the direction of the transverse axis 216 of the first side wall 16.

As can be seen in FIGS. 4 and 7, the plurality of offset sections include a first corner section 240 located adjacent to first front corner 226 defined between the first side wall 16 and the front end wall 12. First corner section 240 includes a first corner section first side edge 242 located at the first corner defined between the first side wall 16 and the front end wall 12 and a first corner section second side edge 244 spaced apart from the first corner section first side edge 242 in the direction of the transverse axis 216 of the first side wall 16. The plurality of offset sections further include a second corner section 250 located adjacent to first rear corner 228 defined between the second side edge 214 of the first side wall 16 and the first side edge 82 of the rear end wall 14 and having a second corner section first side edge 252 located at the first rear corner defined between the first side wall 16 and the rear end wall 14 and a second corner section second side edge 254 spaced apart from the second corner section first side edge 252 in the direction of the transverse axis 216 of the first side wall 16. As can be seen in FIG. 7, the outside surface of the first corner section 240 is positioned to be coplanar with the outside surface of the second corner section 250.

The studs on the first corner section 240 and on the second corner section 250 have inside surfaces 256 that are spaced apart from the inside surface of the first corner section 240 and the second corner section 250. A first corner section acoustic panel 258 is mounted on the inside surfaces of the studs on the first corner section 240 and a second corner section acoustic panel 260 is mounted on the inside surfaces of the studs on the second corner section 250.

The plurality of offset sections further include a first intermediate offset section 262 positioned between the first corner section 240 and the second corner section 250. First intermediate offset section 262 includes an inside surface 264, an outside surface 266, two studs 220C and 220D on the inside surface 264 of the first intermediate offset section 262, a first intermediate offset section first side edge 268, a first intermediate offset section second side edge 270 which is spaced apart from the first intermediate section first side edge 268 in the direction of the transverse axis 216 of the first side wall 16, a first intermediate offset section top edge 272 that is coplanar with the top edge 208 of the first side wall 16 and a first intermediate offset section bottom edge (not visible in FIG. 7, and which is congruent with top edge 272) that is coplanar with the bottom edge 206 of the first side wall 16. An acoustic panel 276 is mounted on the inside surface 264 of the first intermediate offset section 262 between the two studs of the first intermediate offset section 262.

The plurality of offset sections further including a second intermediate offset section 280 positioned between the first corner section 240 and the second corner section 250. Second intermediate offset section 280 includes an inside surface 282, an outside surface 284, and two studs 220E and 220F on the inside surface 282 of the second intermediate offset section 280. Each of the two studs on the inside surface 282 of the second intermediate offset section 280 has an inside surface 286 that is spaced apart from the inside surface 282 of the second intermediate offset section 280. Second intermediate offset section 280 further includes a second intermediate offset section first side edge 288, a second intermediate offset section second side edge 290 spaced apart from the second intermediate section first side edge 288 in the direction of the transverse axis 216 of the first side wall 16, a second intermediate section top edge 292 that is coplanar with the top edge 104 of the first side wall 16 and a second intermediate section bottom edge (not seen in FIG. 7 and congruent with top edge 292) that is coplanar with the bottom edge 206 of the first side wall 16. An acoustic panel 294 is mounted on the inside surfaces 286 of the studs mounted on the inside surface 282 of the second intermediate offset section 280 and is spaced apart from the inside surface 282 of the second intermediate offset section 280. The outside surface of the intermediate offset section 298 that is located adjacent to the first corner section 240 is spaced apart from the acoustic panel on the first corner section in the direction of the transverse axis 44 of the front end wall 12 and defines a first side wall exit air gap 300 between the intermediate offset section adjacent to the first corner section 240 and the first corner section 240. The outside surface 266 of the first intermediate offset section 262 is spaced apart from the acoustic panel on the second corner section 250 to define a second side wall exit air gap 302 between the first intermediate offset section 262 and the second corner section 250. The outside surface 284 of the second intermediate offset section 280 is coplanar with the outside surfaces of the first corner section 240 and the second corner section 250.

The plurality of offset sections further include a third intermediate offset section 308 which is identical to the first intermediate offset section 262 and includes a first side edge 310 located near the first side edge 288 of the second intermediate offset section 280. Outside surface 312 of the third intermediate offset section 308 is spaced apart from the acoustic panel 294 on the second intermediate offset section 280 defining a third side wall exit air gap 316 between the second intermediate offset section 280 and the third intermediate offset section 308. The outside surface 312 of the third intermediate offset section 308 is coplanar with the outside surface 266 of the first intermediate offset section 262.

As will be understood by those skilled in the art based on the teaching of the present disclosure, the offset sections of the side wall define a plurality of air exit gaps through which air from inside structure 10 flows as indicated by arrows, such as air exit flow arrow 320 in FIG. 7. The exit air gaps are sized to permit free flow of air out of the structure 10 but to keep sound inside the structure 10. A preferred exit air gap size is 1 ¾ inches.

Structure 10 further includes second side wall 18 extending between the front end wall 12 and the rear end wall 14. Second side wall 18 is identical to the just-described first side wall 16 and has a plurality of offset panels and a plurality of exit air gaps defined between adjacent offset panels, with adjacent panels of the second side wall 18 being offset from each other in the direction of the transverse axis 44 of the front end wall 12. Odd number panels have outside surfaces that are coplanar with each other and even number panels have outside surfaces that are coplanar with each other as just described in reference to side wall 16. Further description of side wall 18 will not be presented, with the above description of side wall 16 being incorporated and referenced for such description.

Figure 5:
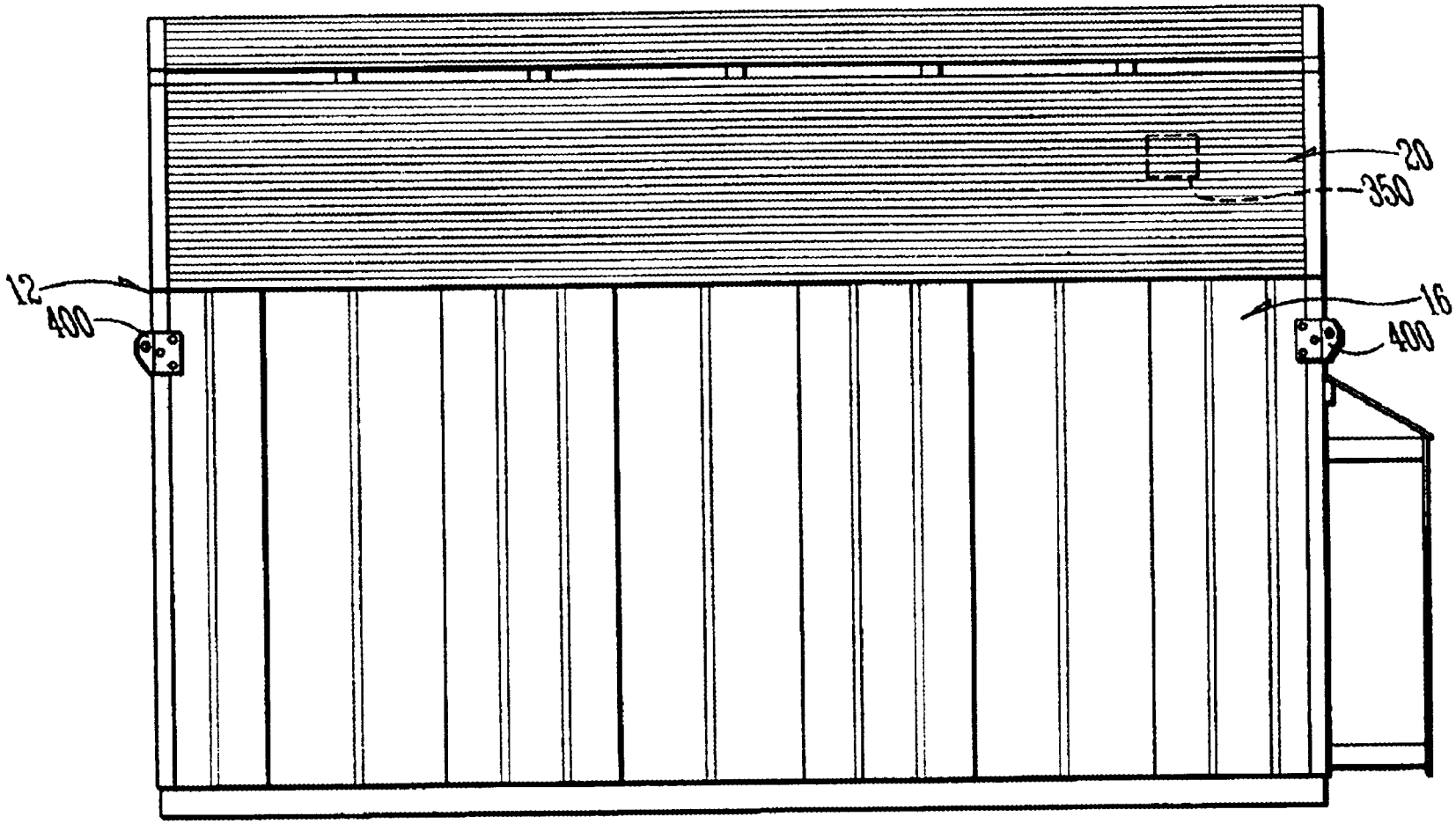
FIG. 5 is a side elevational view of the static structure of the present invention.

As shown in FIGS. 2, 3, and 5, structure 10 further includes roof 20 on the top edge 36 of the front end wall 12 and the top edge 78 of the rear end wall 14. Roof 20 includes a first roof section 340 which has an inside surface 342, an outside surface 344, a proximal end 346 fixed to the first side wall 16, a distal end 348 spaced apart from the first side wall 16 in the direction of the transverse axis 44 of the front end wall 12 and a plurality of acoustic panels, such as acoustic panel 350 indicated in FIG. 5, mounted on the inside surface 342 of the first roof section 340. Acoustic panels 350 are identical to the acoustic panels mounted on the walls of the structure. Roof 20 further includes a second roof section 360 having an inside surface 362, an outside surface 364, a proximal end 366 fixed to the second side wall 18 and a distal end 368 spaced apart from the second side wall 18 in the direction of the transverse axis 44 of the front end wall 16. A plurality of acoustic panels, identical to the above-discussed acoustic panels, are mounted on the inside surface 362 of the second roof section 360. The acoustic panels on the second roof section 360 are not shown in the interest of clarity of the figures.

The distal end 348 of the first roof section 340 is spaced apart from the distal end 368 of the second roof section 360 and a roof exit air gap 370 is defined between the two distal ends 348 and 368.

Figure 6:
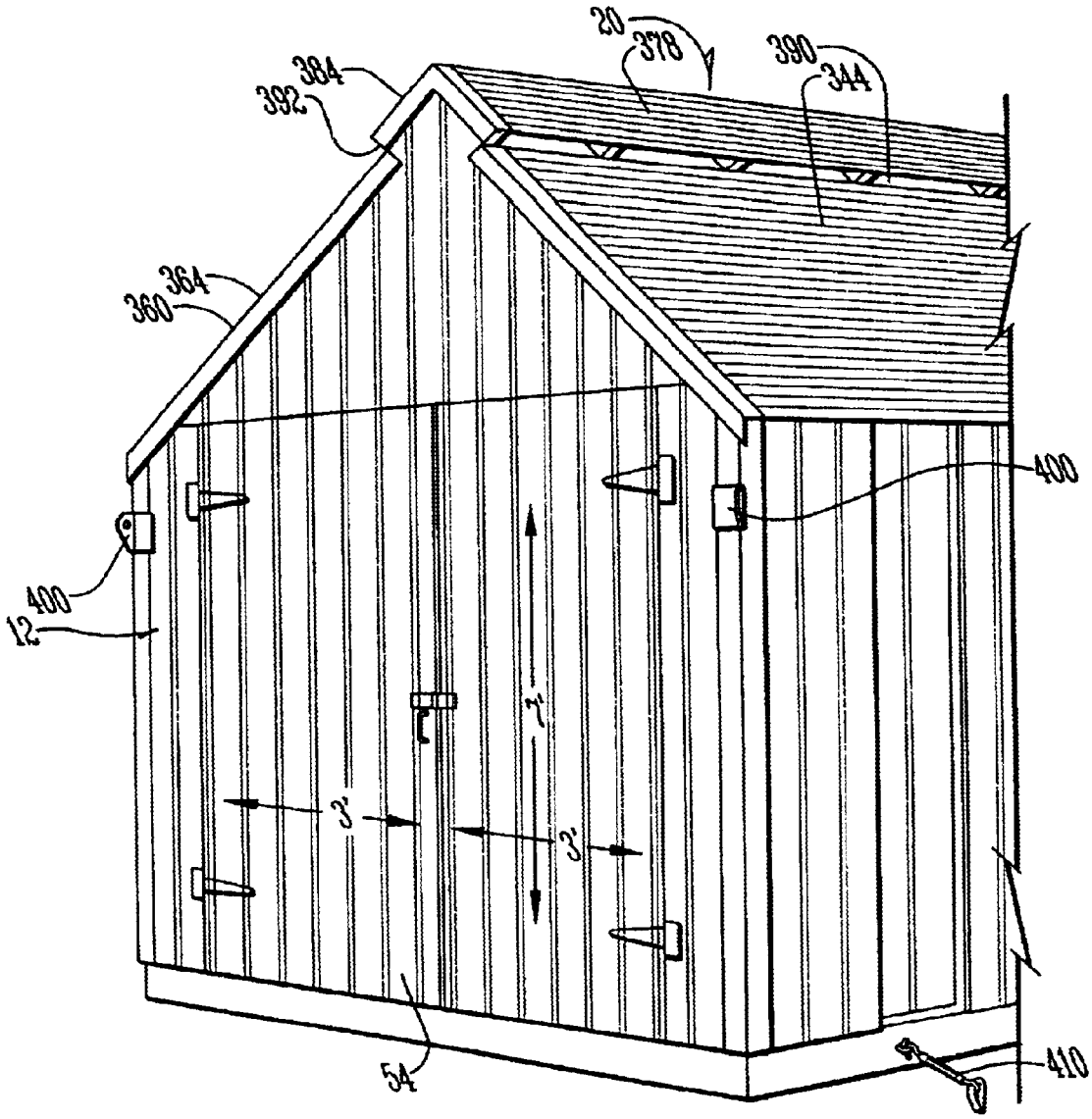
FIG. 6 is an end perspective view of the static structure of the present invention.
Figure 1:
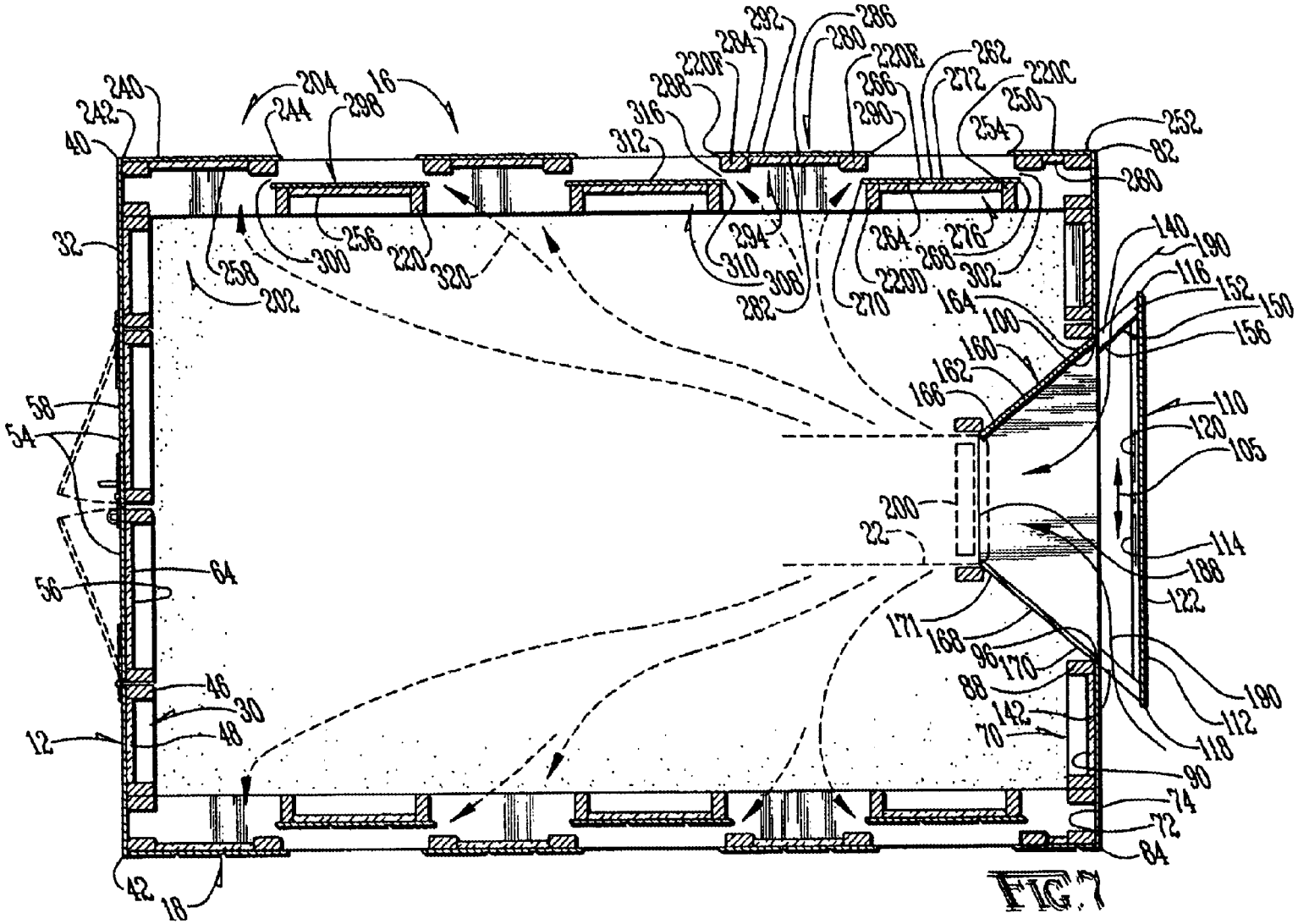

A plurality of roof exit air gap covering walls cover the roof air gap 370 and include a front supporting end wall 374 on the top edge 36 of the front end wall 12, a rear supporting end wall 376 on the top edge 78 of the rear end wall 14, a first covering wall 378 extending from the front supporting end wall 374 to the rear supporting end wall 376 and spaced apart from the distal ends 348 and 368 of the first and second roof sections 340 and 360 and spaced apart from the outside surfaces 344 and 364 of the first and second roof sections 340 and 360. The first covering wall 378 includes a distal end 380 and a proximal end 382. The roof 20 further includes a second covering wall 384 extending from the front supporting end wall 374 to the rear supporting end wall 376 and spaced apart from the distal ends 348 and 368 of the first and second roof sections 340 and 360 and spaced apart from the outside surfaces 344 and 364 of the first and second roof sections 340 and 360. The second covering wall 384 includes a distal end 386 and a proximal end 388 with the proximal end 388 of the second covering wall 384 engaging the proximal end 382 of the first covering wall 378. As shown in FIGS. 3 and 6, a first roof exit air gap 390 is located between the first covering wall 378 and the outside surface 344 of the first roof section 340. A second roof exit air gap 392 is located between the second covering wall 384 and the outside surface 364 of the second roof section 360. The first and second roof exit air gaps 390 and 392 are sized to permit air flow from the inside of the structure 10 while reducing noise flow out of the structure 10. The gaps 390 and 392 are sized and located to prevent moisture from flowing into the structure.

All of the offset sections are connected together by bolts or the like and screens can be placed over the gaps to prevent insects or birds or other undesirable objects from entering the structure 10 via the gaps. The acoustic panels can also be formed of fire retardant materials if desired.

Figure 8:
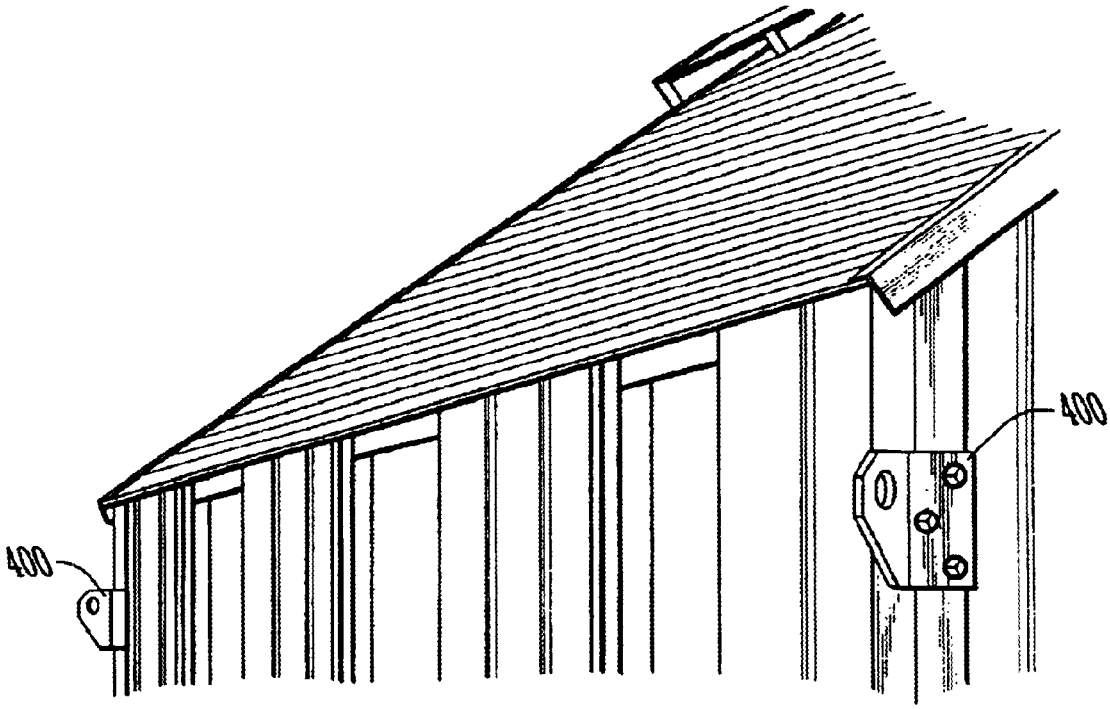
FIG. 8 is a side perspective view of the static structure of the present invention.

Structure 10 can be moved in parts or as a whole from one site to another. In order to permit the structure 10 to be moved as a whole, structure 10 includes a plurality of lifting eyes, such as lifting eye 400 shown in FIGS. 6 and 8, attached to the side walls. In the preferred form of the structure 10, lifting eyes 400 are located on all four corners of the structure 10.

Figure 9:
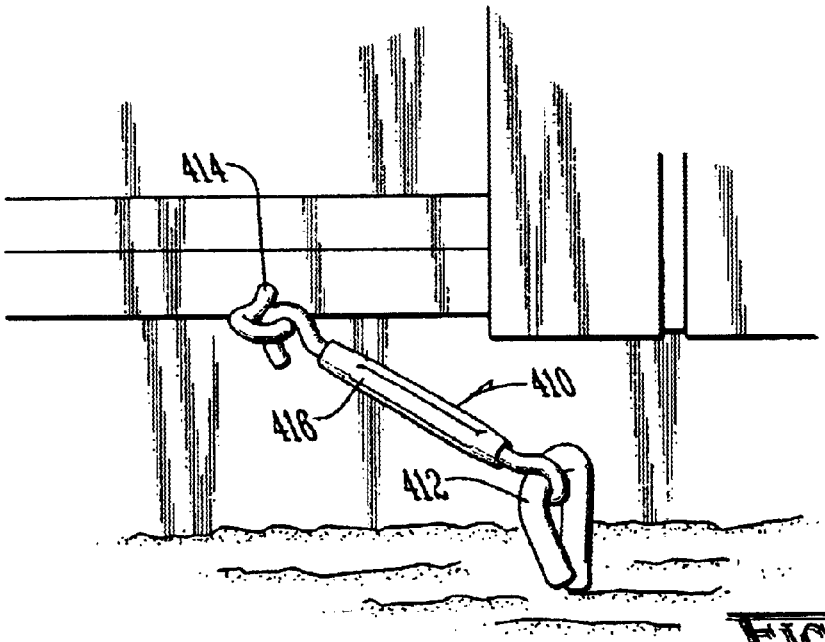
FIG. 9 is a perspective view of an anchoring structure.

In order to ensure secure set up of the structure 10, structure 10 further includes a plurality of anchors, such as anchor 410 shown in FIG. 9 securely connecting the structure 10 to the ground. As shown in FIG. 9, each anchor 410 includes an earth anchor 412 embedded in the earth when in the set-up configuration of the anchor, a wall attachment element 414 attached to one of the first and second side walls 16 and 18 in the set-up configuration of the anchor and a tether 416 connecting the earth anchor 412 to the wall attachment element 414 in the set-up configuration of the anchor 410.

It is understood that while certain forms of the present invention have been illustrated and described herein, it is not to be limited to the specific forms or arrangements of parts described and shown.

What is claimed is:

1. A static structure for housing a gasoline engine comprising:

a) a front end wall having
- (1) an inside surface,
- (2) an outside surface,
- (3) a bottom edge that is located on the ground when said front end wall is in a set-up configuration,
- (4) a top edge spaced apart from the bottom edge,
- (5) a longitudinal axis extending between the top edge and the bottom edge,
- (6) a first side edge,
- (7) a second side edge,
- (8) a transverse axis extending between the first side edge and the second side edge,
- (9) a plurality of studs on the inside surface of said front end wall and extending from the top edge of said front end wall to the bottom edge of said front end wall, the studs being spaced apart from each other in the direction of the transverse axis of said front end wall,
- (10) a plurality of acoustic panels mounted on the inside surface of said front end wall between the studs with each acoustic panel being located between adjacent studs,
- (11) a length dimension extending in the direction of the longitudinal axis from the top edge to the bottom edge of said front end wall,
- (12) a width dimension extending in the direction of the transverse axis from the first side edge to the second side edge of said front end wall, and
- (13) double doors on said front end wall and including
  - (A) an inside surface on each door of the double doors,
  - (B) an outside surface on each door of the double doors,
  - (C) a lock on the double doors,
  - (D) hinges connecting each of the doors of the double doors to said front end wall, and
  - (E) acoustic panels on each door of the double doors;

b) a rear end wall having
- (1) an inside surface,
- (2) an outside surface,
- (3) a bottom edge that is located on the ground when said rear end wall is in a set-up configuration,
- (4) a top edge spaced apart from the bottom edge of said rear end wall,
- (5) a longitudinal axis extending between the top edge of said rear end wall and the bottom edge of said rear end wall,
- (6) a first side edge,
- (7) a second side edge,
- (8) a transverse axis extending between the first side edge of said rear end wall and the second side edge of said rear end wall,
- (9) a plurality of studs on the inside surface of said rear end wall and extending from the top edge of said rear end wall to the bottom edge of said rear end wall, the studs being spaced apart from each other in the direction of the transverse axis of said rear end wall,
- (10) a plurality of acoustic panels mounted on the inside surface of said rear end wall between the studs with each acoustic panel being located between adjacent studs on said rear end wall,
- (11) a length dimension extending in the direction of the longitudinal axis from the top edge to the bottom edge of said rear end wall,

(12) a width dimension extending in the direction of the transverse axis from the first side edge of said rear end wall to the second side edge of said rear end wall,

(13) an opening through said rear end wall and being defined by (A) a bottom edge, (B) a first side spaced from the first side edge of said rear end wall in the direction of the transverse axis of said rear end wall, (C) a second side spaced from the second side edge of said rear end wall in the direction of the transverse axis of said rear end wall, (D) a top edge which extends in the direction of the transverse axis of said rear end wall between the first side of the opening and the second side of the opening and is spaced apart from the top edge of said rear end wall in the direction of the longitudinal axis of said rear end wall, (E) a width dimension which extends between the first side of the opening and the second side of the opening in the direction of the transverse axis of said rear end wall, and (F) a length dimension which extends between the top edge of the opening and the bottom of the opening in the direction of the longitudinal axis of said rear end wall,

(14) a shroud unit on said rear end wall and which includes (A) a front wall spaced apart from the outside surface of said rear end wall which includes (i) an inside surface which is spaced apart from the outside surface of said rear end wall, (ii) a first side edge which is spaced apart from the first side of the opening in said rear end wall, (iii) a second side edge which is spaced apart from the second side of the opening in said rear end wall, (iv) a transverse axis extending between the first side edge of the front wall of the shroud unit and the second side edge of the shroud unit, (v) a top edge which is spaced apart from the top edge of the opening of said rear end wall and spaced apart from the outside surface of said rear end wall, (vi) a bottom edge that is spaced apart from the ground when the shroud unit is in the set-up configuration and is spaced apart from the bottom edge of said rear end wall, (vii) a longitudinal axis extending between the top edge of the front wall of said shroud unit and the bottom edge of the front wall of said shroud unit, (viii) a width dimension measured in the direction of the transverse axis of the front wall of said shroud unit, with the width dimension of the front wall of said shroud unit being greater than the width dimension of the opening in said rear end wall, (ix) a length dimension measured in the direction of the longitudinal axis of the front wall of said shroud unit, with the length dimension of the front wall of said shroud unit being less than the length dimension of the opening in the rear end wall, (x) a first air intake gap defined between the first side edge of the front wall of the shroud unit and the first side of the opening in said rear end wall, and (xi) a second air intake gap defined between the second side edge of the front wall of the shroud unit and the second side of the opening in said rear end wall, (B) a top wall connecting the top edge of the front wall of the shroud unit to the outside surface of said rear end wall adjacent to the top edge of the opening in said rear end wall, the top wall of said shroud unit sloping toward the bottom edge of the front wall of said shroud unit, (C) support struts on the front wall of said shroud unit, each support strut including a proximal end fixed to the inside surface of the front wall of the shroud unit and extending toward said rear end wall, the support struts converging toward each other from the proximal ends and having distal ends spaced apart from the proximal ends, the support struts being spaced apart from each other, (D) an intake air duct unit on said rear wall and including (i) a first duct unit side wall having a proximal end located adjacent to said rear end wall and a distal end spaced apart from the inside surface of said rear end wall, (ii) a second duct unit side wall having a proximal end located adjacent to said rear end wall and a distal end spaced apart from the inside surface of said rear end wall, (iii) a duct unit top wall having a proximal end located adjacent to said rear end wall and a distal end spaced apart from the inside surface of said rear end wall, (iv) a duct unit bottom wall having a proximal end located adjacent to said rear end wall and a distal end spaced apart from the inside surface of said rear end wall, (v) the distal ends of the duct unit first side wall, the duct unit second side wall, the duct unit top wall and the duct unit bottom wall all being coplanar with each other and defining an air intake duct opening that is spaced apart from the inner surface of said rear end wall, and (vi) an intake air path defined between the first and second air intake gaps of the shroud unit and the air intake duct opening;

c) an intake air fan located near the air intake duct opening to be in fluid communication with the intake air path of the shroud unit;

d) a first side wall extending between said front end wall and said rear end wall and having (1) an inside surface, (2) an outside surface, (3) a bottom edge that is located on the ground when said first side wall is in a set-up configuration, (4) a top edge spaced apart from the bottom edge of said first side wall, (5) a longitudinal axis extending between the top edge of said first side wall and the bottom edge of said first side wall, (6) a first side edge, (7) a second side edge, (8) a transverse axis extending between the first side edge of the first side wall and the second side edge of the first side wall, (9) a plurality of studs on the inside surface of said first side wall and extending from the top edge of said first end wall to the bottom edge of said first side wall, the studs being spaced apart from each other in the direction of the transverse axis of said first side wall,

(10) a length dimension extending in the direction of the longitudinal axis of said first side wall from the top edge of said first side wall to the bottom edge of said first side wall,

(11) a width dimension extending in the direction of the transverse axis of said first side wall from the first side edge of said first side wall to the second side edge of said first side wall,

(12) a first front corner located between the first side edge of said first side wall and the first side edge of said front end wall,

(13) a first rear corner located between the second side edge of said first side wall and the first side edge of said rear end wall,

(14) a plurality of offset sections in said first side wall, each offset section including (A) an inside surface, (B) an outside surface, (C) two studs on the inside surface of the offset section, (D) a first side edge extending between the top edge of said first side wall and the bottom edge of said first side wall, (E) a second side edge extending between the top edge of said first side wall and the bottom edge of said first side wall and spaced apart from the first side edge of the offset section in the direction of the transverse axis of said first side wall,

(15) said plurality of offset sections including (A) a first corner section located adjacent to the first corner defined between said first side wall and said front end wall and having a first corner section first side edge located at the first corner defined between said first side wall and said front end wall, and a first corner section second side edge spaced apart from the first corner section first side edge in the direction of the transverse axis of said first side wall, (B) a second corner section located adjacent to the first rear corner defined between the second edge of said side wall and the first side edge of said rear end wall and having a second corner section first side edge located at the first rear corner defined between said first side wall and said rear end wall, and a second corner section second side edge spaced apart from the second corner section first side edge in the direction of the transverse axis of said first side wall,

(16) the outside surface of the first corner section being coplanar with the outside surface of the second corner section,

(17) the studs on the first corner section and on the second corner section having inside surfaces that are spaced apart from the inside surface of the first corner section and the second corner section,

(18) a first corner section acoustic panel mounted on the inside surfaces of the studs on the first corner section,

(19) a second corner section acoustic panel mounted on the inside surfaces of the studs on the second corner section,

(20) a first intermediate offset section positioned between the first corner section and the second corner section, the first intermediate offset section including (A) an inside surface, (B) an outside surface, (C) two studs on the inside surface of the first intermediate offset section, (D) a first intermediate offset section first side edge, (E) a first intermediate offset section second side edge which is spaced apart from the first intermediate section first side edge in the direction of the transverse axis of said first side wall, (F) a first intermediate offset section top edge that is coplanar with the top edge of said first side wall, (G) a first intermediate offset section bottom edge that is coplanar with the bottom edge of said first side wall, (H) an acoustic panel mounted on the inside surface of the first intermediate offset section between the two studs of the first intermediate offset section,

(21) a second intermediate offset section positioned between the first corner section and the second corner section, the second intermediate offset section including (A) an inside surface, (B) an outside surface, (C) two studs on the inside surface of the second intermediate offset section, each of the two studs on the inside surface of the second intermediate offset section having an inside surface that is spaced apart from the inside surface of the second intermediate offset section, (D) a second intermediate offset section first side edge, (E) a second intermediate offset section second side edge which is spaced apart from the second intermediate offset section first side edge in the direction of the transverse axis of said first side wall, (F) a second intermediate offset section top edge that is coplanar with the top edge of said first side wall, (G) a second intermediate offset section bottom edge that is coplanar with the bottom edge of said first side wall, (H) an acoustic panel mounted on the inside surfaces of the studs on the inside surface of the second intermediate offset section and spaced apart from the inside surface of the second intermediate offset section,

(22) the outside surface of the intermediate offset section adjacent to the first corner section being spaced apart from the acoustic panel on the first corner section in the direction of the transverse axis of said front end wall and defining a first side wall exit air gap between the first intermediate offset section and the first corner section,

(23) the outside surface of the second offset section being spaced apart from the acoustic panel on the second corner section to define a second side wall exit air gap between the first intermediate offset section and the second intermediate offset section,

(24) the outside surface of the second intermediate offset section being coplanar with the outside surfaces of the first and second corner sections, and

(25) a third intermediate offset section which is identical to the first intermediate offset section and which includes a first side edge located near the second side edge of the second intermediate offset section, the outside surface of the third intermediate offset section being spaced apart from the acoustic panel on the second intermediate offset section and defining a third side wall exit air gap between the second intermediate offset section and the third intermediate offset section, the outside surface of the third intermediate offset section being coplanar with the outside surface of the first intermediate offset section;

e) a second side wall extending between said front end wall and said rear end wall and having a plurality of offset panels and a plurality of exit air gaps defined between adjacent offset panels, with adjacent panels of said second side wall being offset from each other in the direction of the transverse axis of said front end wall, with odd number panels having outside surfaces that are coplanar with each other and even number panels having outside surfaces that are coplanar with each other;

f) a roof on the top edges of the front end wall and the rear end wall, said roof including
(1) a first roof section having
(A) an inside surface,
(B) an outside surface,
(C) a proximal end fixed to said first side wall,
(D) a distal end spaced apart from said first side wall in the direction of the transverse axis of said front end wall, and
(E) a plurality of acoustic panels mounted on the inside surface of the first roof section,
(2) a second roof section having
(A) an inside surface,
(B) an outside surface,
(C) a proximal end fixed to said second side wall,
(D) a distal end spaced apart from said second side wall in the direction of the transverse axis of said front end wall, and
(E) a plurality of acoustic panels mounted on the inside surface of the second roof section,
(3) the distal end of the first roof section being spaced apart from the distal end of the second roof section and defining a roof exit air gap,
(4) a plurality of roof exit air gap covering walls which include
(A) a front supporting end wall on the top edge of said front end wall,
(B) a rear supporting end wall on the top edge of said rear end wall,
(C) a first covering wall extending from the front supporting end wall to the rear supporting end wall and spaced apart from the distal ends of the first and second roof sections and spaced apart from the outside surfaces of the first and second roof sections, the first covering wall including a distal end and a proximal end,
(D) a second covering wall extending from the front supporting end wall to the rear supporting end wall and spaced apart from the distal ends of the first and second roof sections and spaced apart from the outside surfaces of the first and second roof sections, the second covering wall including a distal end and a proximal end, with the proximal end of the second covering wall engaging the proximal end of the first covering wall,
(E) a first roof exit air gap located between the first covering wall and the outside surface of the first roof section, and
(F) a second roof exit air gap located between the second covering wall and the outside surface of the second roof section;

g) a plurality of lifting eyes attached to said side walls; and h) a plurality of anchors with each anchor including
(1) an earth anchor embedded in the earth when in the set-up configuration of the anchor,
(2) a wall attachment element attached to one of the first and second side walls in the set-up configuration of the anchor, and
(3) a tether connecting the earth anchor to the wall attachment element in the set-up configuration of the anchor.

2. The static structure as described in claim 1 further including a supporting pallet interposed between the bottom edges of said rear end wall, said front end wall and said side walls and the ground in the set-up configuration.

3. A static structure for housing a gasoline engine comprising:

a) a front end wall;

b) a rear end wall;

c) a door in said front end wall;

d) a shroud unit on said rear end wall;

e) a roof;

f) a first side wall;

g) a second side wall;

h) a plurality of offset sections in both said first side wall and said second side wall, each offset section of said plurality of offset sections being spaced apart from offset sections immediately adjacent thereto;

i) an air exit gap defined between each offset section and the offset sections adjacent thereto;

j) an air exit gap defined through said roof;

k) an air intake duct connected to said shroud unit;

l) an air intake fan fluidically connected to said air intake duct, m) an acoustic panel mounted on each offset section;

n) a plurality of acoustic panels mounted on said roof; and o) an inlet air gap defined between said shroud unit and said rear wall, with said inlet air gap being fluidically connected to said air intake duct.

* * * * *